US010099355B2

(12) United States Patent
Chen

(10) Patent No.: US 10,099,355 B2
(45) Date of Patent: Oct. 16, 2018

(54) TORQUE OUTPUT TOOL AND TORQUE OUTPUT ASSEMBLY

(71) Applicant: CHERVON (HK) LIMITED, Wanchai (HK)

(72) Inventor: Liang Chen, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 111 days.

(21) Appl. No.: 15/221,910

(22) Filed: Jul. 28, 2016

(65) Prior Publication Data

US 2017/0036328 A1 Feb. 9, 2017

(30) Foreign Application Priority Data

Aug. 3, 2015 (CN) ..... 2015 1 0468086
Aug. 3, 2015 (CN) ..... 2015 2 0573406 U

(51) Int. Cl.

| | |
|---|---|
| ***B25B 23/00*** | (2006.01) |
| ***B25B 21/00*** | (2006.01) |
| ***B25B 21/02*** | (2006.01) |
| ***B25B 23/12*** | (2006.01) |

(52) U.S. Cl.

CPC ..... *B25B 23/0035* (2013.01); *B25B 21/02* (2013.01); *B25B 21/026* (2013.01); *B25B 23/12* (2013.01)

(58) Field of Classification Search

CPC ..... B25B 23/12; B25B 21/026
USPC ..... 81/57.36
See application file for complete search history.

(56) References Cited

U.S. PATENT DOCUMENTS

| | | | | |
|---|---|---|---|---|
| 3,875,829 | A * | 4/1975 | Evans | B25B 13/06 81/177.2 |
| 5,361,656 | A * | 11/1994 | Starr | B25B 23/00 81/177.85 |
| 5,568,757 | A * | 10/1996 | Lewis | B25B 15/001 81/177.2 |
| 7,114,418 | B1 * | 10/2006 | Allen | B25B 13/48 81/439 |
| 2001/0007213 | A1 * | 7/2001 | Hyatt | B21K 5/16 81/124.6 |
| 2006/0175773 | A1 * | 8/2006 | Tsai | B25B 15/001 279/143 |
| 2007/0051216 | A1 * | 3/2007 | Chen | B25B 15/02 81/438 |

* cited by examiner

*Primary Examiner* — Hadi Shakeri
(74) *Attorney, Agent, or Firm* — Greenberg Traurig, LLP

(57) ABSTRACT

A torque output tool includes a torque output assembly for outputting torque, a transmission mechanism for driving the torque output assembly to rotate about a central axis, a prime mover for driving the transmission mechanism, and a housing for containing the prime mover. The torque output assembly includes a torque output element including an insert hole, an inner transmission surface for driving a first work head inserted in the insert hole, an outer transmission surface for driving a second work head mounted on the torque output element, a magnetic element for attracting the second work head driven by the torque output element, and a bracket for supporting the magnetic element outside the insert hole. The inner transmission surface is located inside the insert hole and the outer transmission surface is located outside the insert hole.

16 Claims, 8 Drawing Sheets

TORQUE OUTPUT TOOL AND TORQUE OUTPUT ASSEMBLY

RELATED APPLICATION INFORMATION

This application claims the benefit under 35 U.S.C. § 119(a) of Chinese Patent Application No. CN 201510468086.5, filed on Aug. 3, 2015, and Chinese Patent Application No. CN 201520573406.9, filed on Aug. 3, 2015, each of which is incorporated herein by reference in its entirety.

FIELD OF THE DISCLOSURE

The present disclosure relates generally to torque output tools and torque output assemblies.

BACKGROUND OF THE DISCLOSURE

Torque output tools are configured to output torque. Generally, the torque output tool includes a rotating output element for driving a fastener. Currently known torque output tools include screwdrivers and torque wrenches. The torque output tool includes a torque output assembly which is able to clamp a screwdriver bit or a sleeve. The torque output assembly is rotated to drive the screwdriver bit or the sleeve so as to disassemble or assemble a screw or a bolt.

At present there is a multi-function torque output tool which can act as the screwdriver and the wrench through changing the screwdriver bit and the sleeve.

However, the known structure for mounting the screwdriver bit or the sleeve is complex, and it is difficult for a user to change them. Further, currently used output shafts have a big size which does not facilitate operation in a narrow space.

The statements in this section merely provide background information related to the present disclosure and may not constitute prior art.

SUMMARY

In one aspect of the disclosure, a torque output tool includes a torque output assembly for outputting torque, a transmission mechanism for driving the torque output assembly to rotate about a central axis, a prime mover for driving the transmission mechanism and a housing for containing the prime mover. The torque output assembly includes a torque output element including an insert hole, an inner transmission surface for driving a first work head inserted in the insert hole and an outer transmission surface for driving a second work head mounted on the torque output element, a magnetic element for attracting the second work head driven by the torque output element and a bracket for supporting the magnetic element outside the insert hole. The inner transmission surface is located inside the insert hole while the outer transmission surface is located outside the insert hole.

In another aspect of the disclosure, a torque output assembly includes a torque output element including an insert hole, an inner transmission surface for driving a first work head inserted in the insert hole and an outer transmission surface for driving a second work head mounted on the torque output element, a magnetic element for attracting the second work head driven by the torque output element, and a bracket for supporting the magnetic element outside the insert hole. The inner transmission surface is located inside the insert hole while the outer transmission surface is located outside the insert hole.

Further areas of applicability will become apparent from the description provided herein. It should be understood that the description and specific examples are intended for purposes of illustration only and are not intended to limit the scope of the present disclosure.

Figure 1:
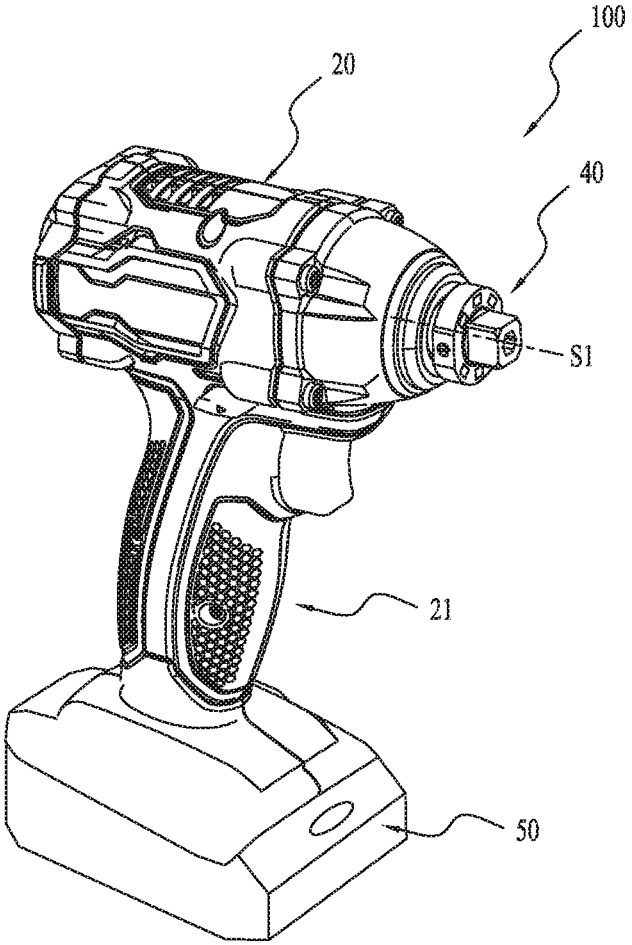
FIG. 1 is a schematic view of an exemplary torque output tool.

The drawings described herein are for illustrative purposes only of selected embodiments and not all possible implementations, and are not intended to limit the scope of the present disclosure. Corresponding reference numerals indicate corresponding parts throughout the several views of the drawings.

DETAILED DESCRIPTION

The following description of the preferred embodiments is merely exemplary in nature and is in no way intended to limit the invention hereinafter claimed, its application, or uses.

Figure 2:
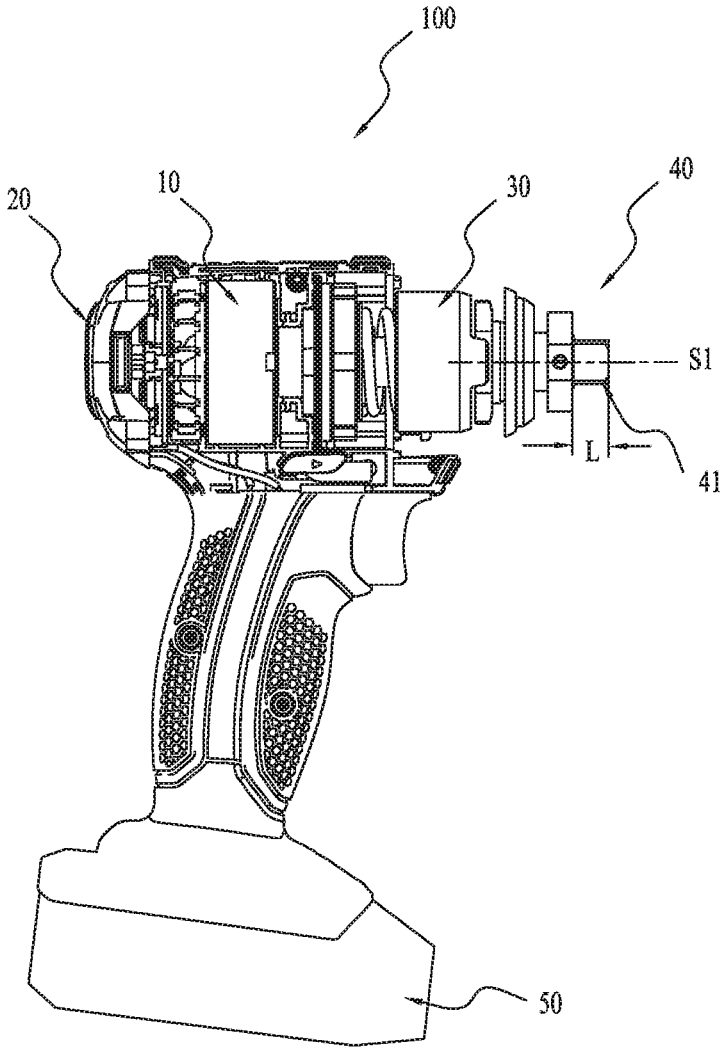
FIG. 2 is a schematic view of a part of the torque output tool in FIG. 1.

Referring to FIGS. 1-2, a torque output tool 100 includes a prime mover 10, a housing 20, a transmission mechanism 30 and a torque output assembly 40.

As shown in FIG. 2, the prime mover 10 is used to output power. Specifically, the prime mover 10 is a motor. Further, the prime mover 10 is a DC motor.

In other embodiments, the prime mover 10 can be an internal combustion engine. It is contemplated that the exchange between the motor, the internal combustion engine and other power device is easy. Thus, the prime mover 10 is not limited to a motor.

The torque output tool 100 can be configured as a handheld tool. The housing 20 forms a gripping portion 21 for a user to grip.

The housing 20 is made from plastic and composed of two halves so as to contain the prime mover 10.

The transmission mechanism 30 is used to drive the torque output assembly 40 to rotate about a central axis S1. For conveniently illustrating, the central axis S1 is used as a reference to define an axial direction, a radial direction and a circumferential direction.

The transmission mechanism 30 is contained in the housing 20, which is driven by the prime mover 10. The transmission mechanism 30 reduces the high speed of the prime mover 10 and transfers the prime mover output to the torque output assembly 40.

The transmission mechanism 30 can be provided with an impact function. That is to say, the transmission mechanism 30 can drive the torque output assembly 40 to move along the central axis S1, while outputting the torque.

As shown in FIG. 1, the torque output tool 100 further includes a battery pack 50 for supplying power to the prime mover 10 which is detachably mounted to the housing 20.

Specifically, the battery pack 50 is connected to the gripping portion 21 of the housing 20.

Figure 3:
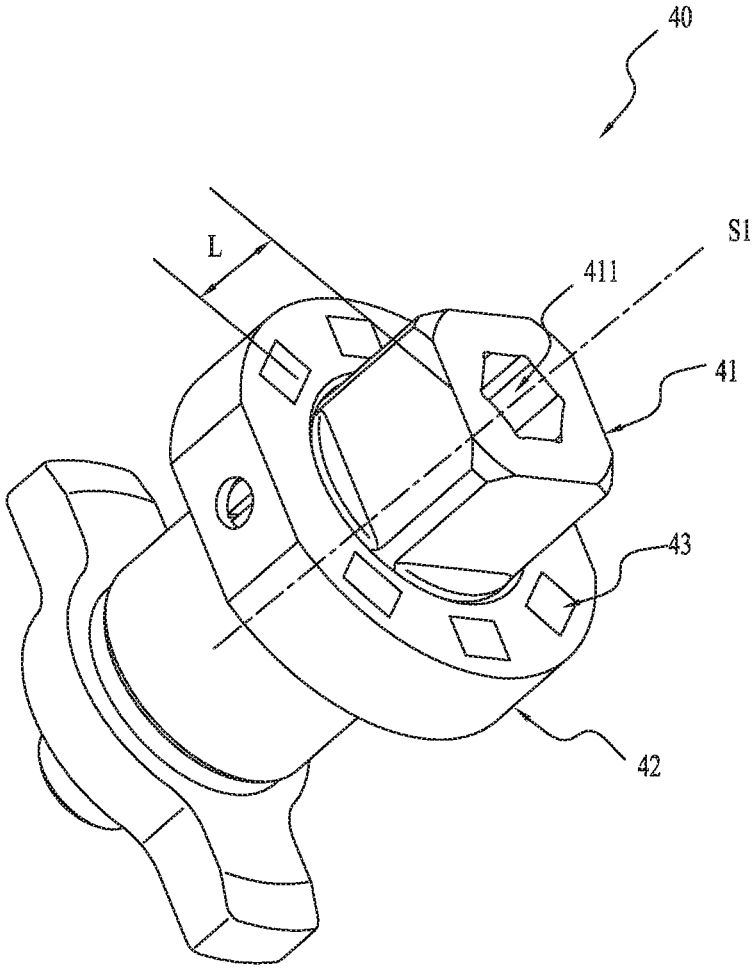
FIG. 3 is a schematic view of a torque output assembly of the torque output tool in FIG. 1.

As shown in FIG. 3, the torque output assembly 40 includes a torque output element 41, a bracket 42, and a magnetic element 43.

The torque output element 41 is driven by the transmission mechanism 30 to rotate about the central axis S1 relative to the housing 20 so as to output the torque.

Figure 4:
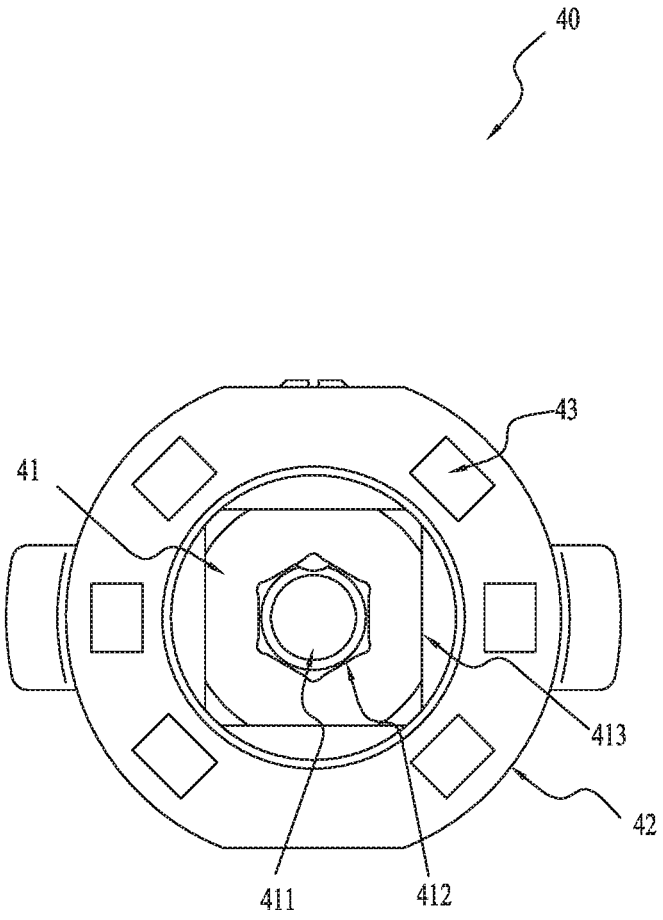
FIG. 4 is a plan view of the torque output assembly in FIG. 3.
Figure 5:
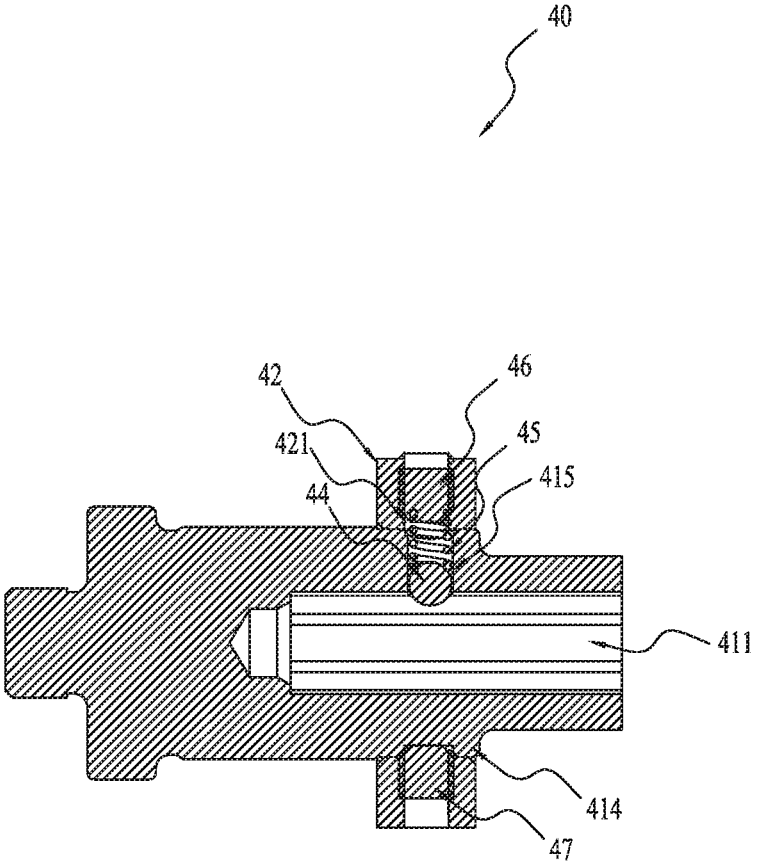
FIG. 5 is a sectional view of the torque output assembly in FIG. 3 along a direction of a central axis.
Figure 6:
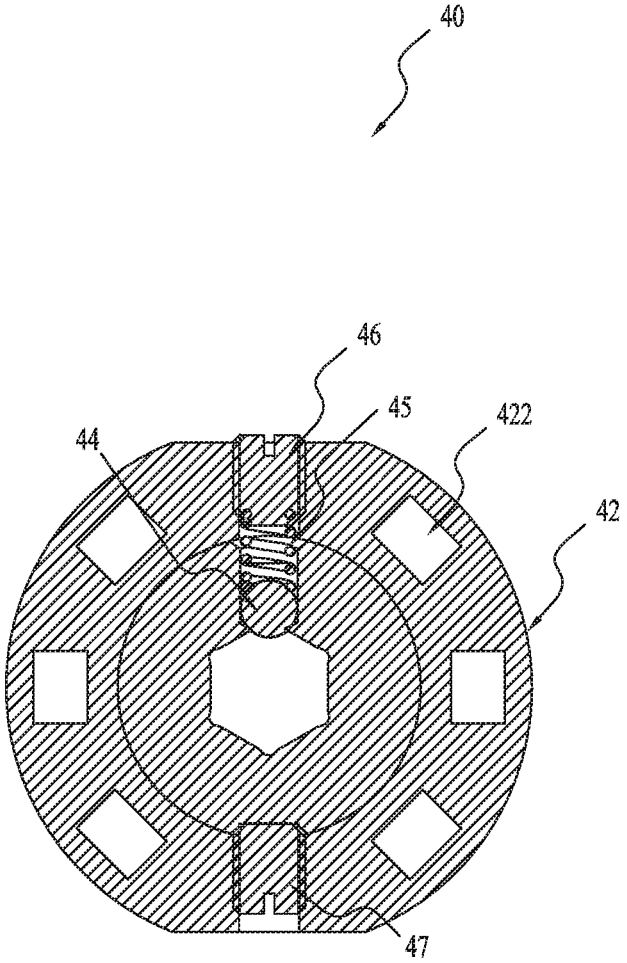
FIG. 6 is a sectional view of the torque output assembly in FIG. 3 along a direction perpendicular to the central axis.

Referring to FIGS. 4-6, the torque output element 41 is formed with an insert hole 411, an inner transmission surface 412, and an outer transmission surface 413.

The inner transmission surface 412 is located in the insert hole 411. A first distance between the outer transmission surface 413 and the central axis S1 is greater than a second distance between the inner transmission surface 412 and the central axis S1. Both the inner transmission surface 412 and the outer transmission surface 413 are parallel to the central axis S1.

The amount of inner transmission surfaces 412 and outer transmission surfaces 413 may be two or more, which can be acting surfaces for transferring the torque. As shown in FIG. 3, there are six inner transmission surfaces 412 and four outer transmission surfaces 413.

Figure 7:
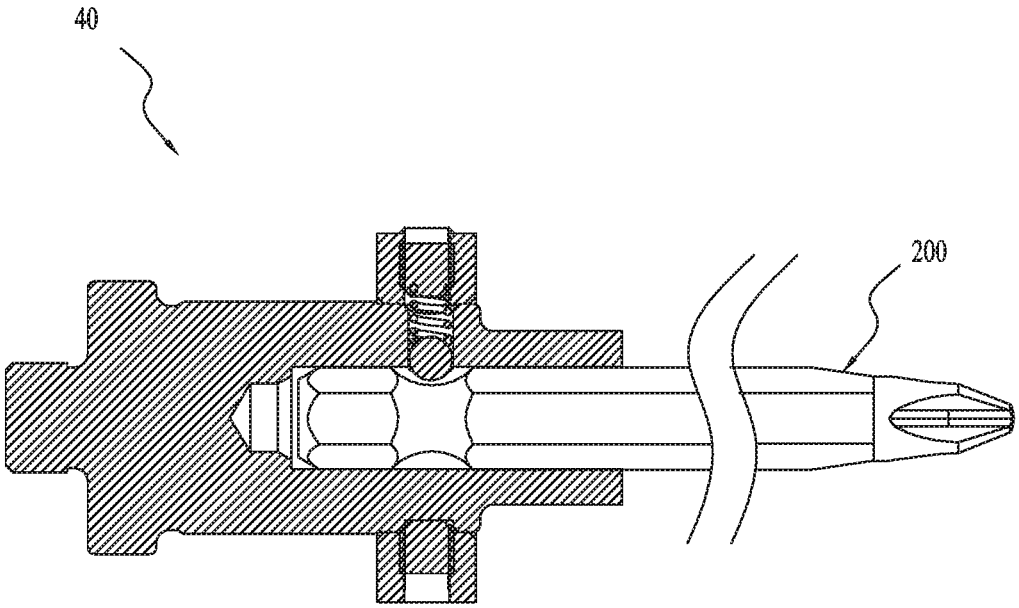
FIG. 7 is a schematic view of the torque output assembly mounted with a screwdriver bit.

Six central symmetrical inner transmission surfaces 412, which can be symmetrical relative to the central axis S1, are arranged in the insert hole 411 so that the insert hole 411 is configured as an inner hexangular hole. Thus, the torque output element 41 can be engaged with a first work head with an outer hexangular handle, for example, a screwdriver bit 200 for driving a bolt as shown in FIG. 7.

Figure 8:
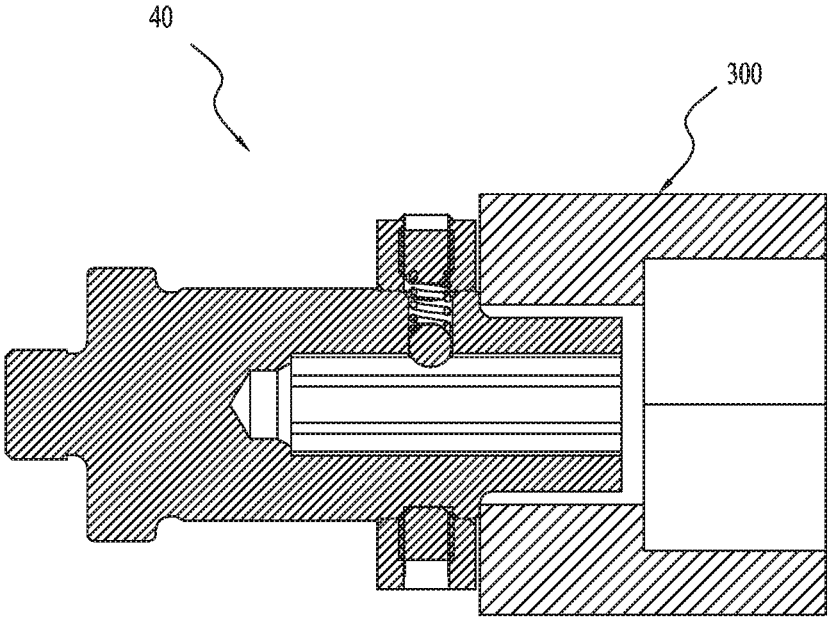
FIG. 8 is a schematic view of the torque output assembly mounted with a wrench sleeve.

Four central symmetrical outer transmission surfaces 413, which can be symmetrical relative to the central axis S1, are arranged outside the insert hole 411 so that the front end of the torque output element 41 can be inserted in a square hole. Thus, the torque output element 41 can be engaged with a second work head with a hole, for example, a wrench sleeve 300 for driving a bolt and a nut as shown in FIG. 8.

The bracket 42 is fixedly connected with the torque output element 41 so that they can rotate together. The bracket 42 is used to support and mount the magnetic element 43.

The magnetic element 43 is connected with the bracket 42 and located outside the outer transmission surfaces 413. Thus, the magnetic element 43 is capable of attracting the second work head mounted on the front end of the torque output element 41 so as to prevent the second work head from disconnecting.

The magnetic element 43 should have the appropriate attracting force. The attracting force should overcome the gravity of the second work head, and the attracting force should not too large to cause the work head be difficult to be changed.

In other embodiments, the magnetic element 43 can be replaced by electromagnet which can be supplied power by the battery pack 50. During operation of the tool, a magnetic field is produced when the electricity is on. When the tool is not used and the electricity is off, the magnetic field is disappeared. The attracting force of the magnetic element 43 against the wrench sleeve 300 is greater than or equal to 10 N.

As shown in FIG. 6, the bracket 42 is formed with a containing recess 422 for containing the magnetic element 43. A third distance between the magnetic element 43 and the central axis S1 is greater than the first distance.

As shown in FIG. 5, a portion of the torque output element 41 is configured as a cylinder 414. The bracket 42 is mounted on an outside surface of the cylinder 414. The outside surface of the cylinder 414 is located outside the outer transmission surfaces 413. A fourth distance between the outside surface of the cylinder 414 and the central axis S1 is greater than the first distance.

Referring to FIGS. 7-8, with the torque output element 41, the torque output tool 100 is capable of using two kinds of work heads, such as the screwdriver bit 200 and the wrench sleeve 300. So the torque output tool 100 can act as a screwdriver and a wrench. The bracket 42 and the magnetic element 43 are arranged on one end of the torque output element 41 that is farthest from the housing 20, which does not affect the axial size of the outer transmission surfaces 413 and can provide the effective torque transfer.

As shown in FIG. 5, the torque output assembly 40 includes a limiting element 44 and a biasing element 45.

The limiting element 44 is used to limiting the axial position of the screwdriver bit 200, which is the position in the direction of the central axis S1.

The bracket 42 and the torque output element 41 constitute a whole which is provided with a containing hole extended to the insert hole 411 along a direction perpendicular to the central axis S1. The containing hole is formed by the bracket 42 and the torque output element 41. The limiting element 44 and the biasing element 45 are contained in the containing hole. One end of the biasing element 45 is fixedly connected with the limiting element 44. The limiting element 44 is biased by the biasing element 45 to partially enter into the insert hole 411. Specifically, the biasing element 45 is a spring and the limiting element 44 has a spherical shape.

The torque output assembly 40 further includes a fixing element 46 which is fixedly connected with the other end of the biasing element 45. The fixing element 46 is fixed on the bracket 42. The torque output element 41 is provided with a first through hole 415 extended along the direction perpendicular to the central axis S1. The bracket 42 is provided with a second through hole 421 extended along the direction perpendicular to the central axis S1. The first through hole 415 and the second through hole 421 constitute the containing hole. The size of one side of the containing hole that is adjacent to the insert hole 411 is decreased. Specifically, the size of one side of the first through hole 415 that is adjacent to the insert hole 411 is decreased to less than the maximum size of the limiting element 44. So the limiting element 44 only can be partially entered into the insert hole 411, which can't be entirely entered into the insert hole 411.

The limiting element 44 and the biasing element 45 can be engaged so as to fix the screwdriver bit and prevent the screwdriver bit from disconnecting. The arrangement has simple structure and high reliability. The containing hole may be only formed by the torque output assembly 40, then the limiting element 44 has a small stroke and the biasing element 45 has small biasing force. In order to make the limiting element 44 have a large stroke and preload force, it is needed to increase the size of the torque output element 41, which cause the torque output element 41 to have a heavy weight so as to affect the output efficiency and working time. So in this instance, the bracket 42 and the torque output element 41 cooperatively form the containing hole, which solves the problem mentioned above.

Referring to FIGS. 2-3, in a direction parallel to the central axis S1, a distance L between the magnetic element 43 and the front end of the outer transmission surface 413 is greater than or equal to 9.5 mm and less than or equal to 11.5 mm.

As shown in FIG. 8, the wrench sleeve 300 is mounted from the furthest edge of the outer transmission surface 413 and moved toward the bracket 42. If the distance L is small, the outer transmission surface 413 has a small size. When the outer transmission surface 413 transfers the torque, deflection may occur so that the torque output is not steadily. If the distance L is large, the outer transmission surface 413 has a large size and the transfer is steadily.

However, because the distance between the magnetic element 43 and the wrench sleeve 300 is increased, the attracting force of the magnetic element 43 is not enough to steadily attract the wrench sleeve 300. So the wrench sleeve 300 may fall off.

Alternatively, when the torque output element 41 is rotated about the central axis S1, the bracket 42 is rotated together with the torque output element 41. In order to realize good dynamic balance and reduce the vibration so as to improve the operation feeling, the bracket 42 has an annular shape and surrounds the torque output element 41. As shown in FIG. 5, the bracket 42 is fixedly connected with the torque output element 41 through a locking element 47.

As shown in FIG. 6, in order to further improve the balance, the locking element 47 and the limiting element 44 are disposed on the opposite sides in the circumferential direction of the central axis S1. An angle between the locking element 47 and the limiting element 44 in the circumferential direction of the central axis S1 is about 180°.

The magnetic element 43 has an annular shape or is symmetrically disposed on the circumference of the central axis S1. When the amount of the magnetic elements 43 is at least two, the magnetic elements 43 can be symmetrically disposed on the circumference of the central axis S1, and the two magnetic elements 43 are centro-symmetric relative to the central axis S1.

Further, the two magnetic elements 43 are disposed on the opposite sides in the circumferential direction of the central axis S1.

As shown in FIG. 6, the magnetic elements 43 are divided into two groups which are arranged symmetrically on the two sides.

As shown in FIG. 4, the amount of the magnetic elements 43 is six, which are symmetric relative to the central axis S1 in pairs in the circumferential direction.

With this arrangement, the magnetic elements 43 are capable of attracting the wrench sleeve 300 steadily, and the deflection is prevented when the magnetic elements 43 attracts the wrench sleeve 300.

The above illustrates and describes basic principles, main features and advantages of the claimed invention. Those skilled in the art should appreciate that the above embodiments do not limit the claimed invention in any form. Technical solutions obtained by equivalent substitution or equivalent variations all fall within the scope of the claimed invention.

What is claimed is:

1. A torque output tool, comprising:

a torque output assembly for outputting torque;

a transmission mechanism for driving the torque output assembly to rotate about a central axis;

a prime mover for driving the transmission mechanism; and a housing for containing the prime mover;

wherein the torque output assembly comprises:

a torque output element comprising:

an insert hole;

an inner transmission surface for driving a first work head inserted in the insert hole; and an outer transmission surface for driving a second work head mounted on the torque output element;

a magnetic element for attracting the second work head driven by the torque output element;

a bracket for supporting the magnetic element outside the insert hole;

a limiting element for limiting the axial position of the first work head inserted in the insert hole; and a biasing element for biasing the limiting element against the first work head;

wherein the inner transmission surface is located inside the insert hole and the outer transmission surface is located outside the insert hole, wherein the bracket has an annular shape which surrounds the torque output element, the annular shape is separately formed and fixedly connected with the torque output element through a locking element, the locking element and the limiting element are disposed on the opposite sides in the circumferential direction of the central axis, and wherein the torque output element is provided with a first through hole extended along the direction perpendicular to the central axis, the bracket is provided with a second through hole extended along the direction perpendicular to the central axis, and the first through hole and the second through hole constitute a containing hole for accommodating the limiting element and the biasing element.

2. The torque output tool of claim 1, wherein the inner transmission surface is parallel to the central axis.

3. The torque output tool of claim 1, wherein the outer transmission surface is parallel to the central axis.

4. The torque output tool of claim 1, wherein a first distance between the outer transmission surface and the central axis is greater than a second distance between the inner transmission surface and the central axis.

5. The torque output tool of claim 1, wherein a third distance between the magnetic element and the central axis is greater than a first distance between the outer transmission surface and the central axis.

6. The torque output tool of claim 1, wherein the biasing element is a coil spring.

7. The torque output tool of claim 1, wherein in a direction parallel to the central axis a distance between the magnetic element and one end of the outer transmission surface that is farthest from the magnetic element is greater than or equal to 9.5 mm and less than or equal to 11.5 mm.

8. The torque output tool of claim 1, wherein the magnetic element has an annular shape or is arranged on the circumference of the central axis.

9. A torque output assembly, comprising:

a torque output element comprising:

an insert hole;

an inner transmission surface for driving a first work head inserted in the insert hole; and an outer transmission surface for driving a second work head mounted on the torque output element;

a magnetic element for attracting the second work head driven by the torque output element;

a bracket for supporting the magnetic element outside the insert hole;

a limiting element for limiting the axial position of the first work head inserted in the insert hole; and a biasing element for biasing the limiting element against the first work head, wherein the inner transmission surface is located inside the insert hole and the outer transmission surface is located outside the insert hole, wherein the bracket has an annular shape which surrounds the torque output element, the annular shape is separately formed and fixedly connected with the torque output element through a locking element, the locking element and the limiting element are disposed on the opposite sides in the circumferential direction of the central axis; and wherein the torque output element is provided with a first through hole extended along the direction perpendicular to the central axis, the bracket is provided with a second through hole extended along the direction perpendicular to the central axis, and the first through hole and the second through hole constitute a containing hole for accommodating the limiting element and the biasing element.

10. The torque output assembly of claim 9, wherein the inner transmission surface is parallel to the central axis.

11. The torque output assembly of claim 9, wherein the outer transmission surface is parallel to the central axis.

12. The torque output assembly of claim 9, wherein a first distance between the outer transmission surface and the central axis is greater than a second distance between the inner transmission surface and the central axis.

13. The torque output assembly of claim 9, wherein a third distance between the magnetic element and the central axis is greater than a first distance between the outer transmission surface and the central axis.

14. The torque output assembly of claim 9, wherein the biasing element is a coil spring.

15. The torque output assembly of claim 9, wherein in a direction parallel to the central axis a distance between the magnetic element and one end of the outer transmission surface that far from the magnetic element is greater than or equal to 9.5 mm and less than or equal to 11.5 mm.

16. The torque output assembly of claim 9, wherein the magnetic element has an annular shape or is arranged on the circumference of the central axis.

* * * * *